US009326609B2

(12) United States Patent
Huang

(10) Patent No.: US 9,326,609 B2
(45) Date of Patent: May 3, 2016

(54) CHAIR CHASSIS AND CHAIR HAVING THE SAME

(71) Applicant: SHANTOU LUXUS FURNITURE LTD., Shantou, Guangdong Province (CN)

(72) Inventor: Junli Huang, Shantou (CN)

(73) Assignee: SHANTOU LUXUS FURNITURE LTD., Shengping Industrial Park, Jinping District, Shantou, Guangdong Province (CN)

( * ) Notice: Subject to any disclaimer, the term of this patent is extended or adjusted under 35 U.S.C. 154(b) by 59 days.

(21) Appl. No.: 14/324,243

(22) Filed: Jul. 7, 2014

(65) Prior Publication Data

US 2015/0272328 A1 Oct. 1, 2015

(30) Foreign Application Priority Data

Mar. 26, 2014 (CN) ..... 2014 1 0117850

(51) Int. Cl.
*A47C 1/032* (2006.01)

(52) U.S. Cl.
CPC ..... *A47C 1/03222* (2013.01)

(58) Field of Classification Search
CPC ..... A47C 1/03255; A47C 1/30205; A47C 1/03222
See application file for complete search history.

(56) References Cited

U.S. PATENT DOCUMENTS

| | | | | | |
|---|---|---|---|---|---|
| 5,308,144 | A * | 5/1994 | Korn | A47C 1/03255 | 297/300.2 |
| 5,664,834 | A * | 9/1997 | Hsu | A47C 1/03255 | 297/300.1 |
| 5,775,774 | A * | 7/1998 | Okano | A47C 1/03255 | 297/300.2 |
| 5,964,503 | A * | 10/1999 | Inoue | A47C 1/03255 | 297/300.1 |
| 6,120,096 | A * | 9/2000 | Miotto | A47C 1/03255 | 297/300.1 |
| 6,439,661 | B1 * | 8/2002 | Brauning | A47C 1/023 | 297/300.2 |
| 6,644,741 | B2 * | 11/2003 | Nelson | A47C 1/03255 | 297/300.1 |
| 6,709,056 | B2 * | 3/2004 | Bock | A47C 1/03255 | 267/155 |
| 6,709,057 | B2 * | 3/2004 | Sander | A47C 1/03294 | 297/300.1 |
| 2013/0057037 | A1 * | 3/2013 | Horiki | A47C 1/03255 | 297/301.1 |

* cited by examiner

*Primary Examiner* — Philip Gabler
(74) *Attorney, Agent, or Firm* — Winston Hsu; Scott Margo

(57) ABSTRACT

Disclosed is a chair chassis, wherein a seat bearing plate is disposed above a main tray base, for bearing a seat, a front end of a movable support member is pivotally connected to the seat bearing plate, a lower end thereof is pivotally connected to the main tray base, the movable support member is pivotable, a pair of movable supporting plates are located in front of the movable support member, upper and lower ends of each movable supporting plate are respectively pivotally connected to the seat bearing plate and the main tray base, and a pivot where the movable support member and the main tray base are connected is mounted with an elastic member for resisting the movable support member from rotating rearward. A user is subject to appropriate pressure when leaning back against the backrest, and friction between the backrest and the user's back may be reduced.

14 Claims, 5 Drawing Sheets

CHAIR CHASSIS AND CHAIR HAVING THE SAME

BACKGROUND OF THE INVENTION

1. Field of Invention

The present application relates to a chair chassis and a chair having the chair chassis.

2. Related Art

For the design of the bearing chassis of the current chair, in order to realize leaning back of the chair backrest, the design is more complex, there are more parts and more screws must be used, which is prone to damage or screw loosening, resulting in a failure. Meanwhile, the design of leaning back makes more use of different modes of springs to bear rearward pressure of the backrest, it is difficult to accurately adapt to a user's weight or activity, rearward movement often may produce excessively light or excessively heavy pressure, and thus more parts are required for calibration purposes. In addition, the distance between the backrest and the seat changes when the backrest is rearward, and the backrest rubs the user's back, resulting in discomfort.

SUMMARY OF THE INVENTION

An object of the present application is to provide a chair chassis and a chair having the chair chassis to overcome the shortcomings of the prior art, so that the user controls leaning back of the backrest with ease, which may not produce excessively light or excessively heavy pressure, and may reduce or even eliminate discomfort brought about by friction between the backrest and the user's back.

A chair chassis is provided, including a main tray base, a seat bearing plate, a movable support member and a pair of movable supporting plates, where the seat bearing plate is disposed above the main tray base, for bearing a seat, a front end of the movable support member is pivotally connected to the seat bearing plate, a lower end of the movable support member is pivotally connected to the main tray base, a rear end of the movable support member is used for connecting a chair backrest, the front end, the lower end and the rear end of the movable support member are in a triangle relationship and the front end and the rear end are pivotable by taking the lower end as a fulcrum, the pair of movable supporting plates are located in front of the movable support member, upper and lower ends of each movable supporting plate are respectively pivotally connected to the seat bearing plate and the main tray base, so that the seat bearing plate is subject to balanced support when moving with the movable support member, and a pivot where the movable support member and the main tray base are connected is mounted with an elastic member for resisting the movable support member from rotating rearward.

A chair is provided, including a seat and a backrest, and further including the chair chassis, where the chair chassis is connected to the backrest and supports the seat.

According to the present application, when a chair user sits on the chair and leans back against the chair backrest, the movable support member is subject to weight pressure of the user transferred by the seat bearing plate and resistance of the elastic member (equal to an elastic restoring force) on the one hand, and on the other hand, is subject to rearward pressure transferred by the backrest, their torque generates balance by taking a lower end of the movable support member pivotally connected to the main tray base as a fulcrum, if the weight pressure applied by a person is greater, balance is generated when the rearward pressure against the backrest is greater, on the contrary, if the weight pressure applied by a person is smaller, balance can be generated when the rearward pressure against the backrest is smaller. Therefore, in order to adjust rearward angle and position of the backrest, persons with different weights need to apply rearward pressure to the backrest which automatically adapts according to weight pressure applied by the persons and degree of resistance of the elastic member, and this just meets different needs of users with different weights (generally, it is more comfortable for persons with greater weight when the reactive force of the backrest that the back is subject to in the rearward process is greater, while it is more comfortable for persons with less weight when the reactive force is less), so that the user may adjust a rearward angle of the backrest with ease according to his own weight, and control the backrest to stay at an angle most suitable for the pressure produced on the back, so that a condition that the pressure of the backrest on the back is excessively light or excessively oppressive may not occur during rearward adjustment and after the backrest is stabilized at appropriate angle and position. When the user needs to reduce leaning back of the chair backrest, the user only needs to slightly lean forward, at this time, in order to balance a force transferred from the movable support member, the backrest clings to the user's back to move forward, so that the rearward pressure of the user's back and the weight pressure applied by the user plus the current restoring force of the elastic member are kept in a balanced state, while in the forward process, the restoring force of the elastic member decreases, and thus the rearward pressure may also decrease correspondingly, in this way, the user may easily control the backrest for arbitrary adjustment, to reinstate the backrest or adjust the backrest to an angle that satisfies the user.

In addition to the above advantages of adaptation, as during rearward adjustment of the backrest, the seat bearing plate moves toward an upper back direction synchronously with the backrest under the driving of the movable support member, and thus the relative distance between the seat and the backrest may not be widened, which may effectively avoid or significantly reduce friction of the backrest on the back of the user in the rearward process.

In a process that the movable support member rotates back and forth around its fulcrum, a front end thereof pivotally connected to the seat bearing plate drives the corresponding rear end of the seat bearing plate to move along a sector track, that is, it is lifted upward while moving rearward, or its position is lowered while it moves forward, the movable supporting plates located in front of the movable support member provide the seat bearing plate with a bearing force that balances it, with the design that the upper and lower ends of the moveable supporting plates are pivotally connected to the seat bearing plate and the main tray base respectively, in addition to providing the bearing force, the movable supporting plates may also perform pivotal linkage when the movable support member drives the seat bearing plate to move, to keep synchronous with movement of the movable support member. In a preferred embodiment, the size and the mounting position of the pair of movable supporting plates meet a condition that a front end of the seat bearing plate is at a lifted tilt angle relative to a rear end of the seat bearing plate when the movable supporting plates move rearward along with the seat bearing plate. Such a lifted tilt angle makes the user seated more comfortably when leaning back.

In a preferred embodiment, a lock mechanism including a screw, a nut and a line control assembly specially configured is used, the line control assembly is used to control the nut to rotate to different angles, and the nut may be switched to a state of locking the screw or a state that the screw moves freely in the nut, so that the user can lock the screw or release the screw by means of the line control, thereby locking the movable support member and the seat bearing plate at appropriate positions by using the screw, or release the screw, making the movable support member and the seat bearing plate movable, so as to adjust the rearward angle of the backrest.

DESCRIPTIONS ABOUT REFERENCE SIGNS

Figure 1:
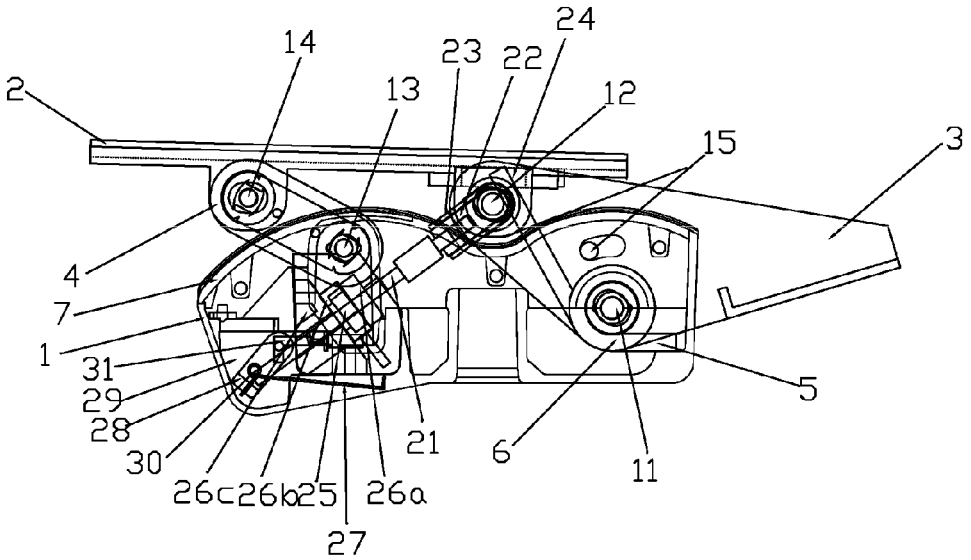
FIG. 1 is a schematic view of an initial state of a chair chassis according to an embodiment of the present application.

1 Main chassis base
2 Seat bearing plate
3 Movable support member
4 Movable supporting plate
5 Elastic member
6 Soundproof spring rubber sleeve
7 Chassis main box top cover
8 Seat
9 Backrest
10 Chair chassis
11 Shaft connecting the movable support member 3 to the main chassis base 1
12 Shaft connecting the movable support member 3 to the seat bearing plate 2
13 Shaft connecting the movable supporting plates 4 to the main chassis base 1
14 Shaft connecting the movable supporting plates 4 to the seat bearing plate 2
15 Limit shaft
21 Screw
22 Connector connecting the screw 21 to the shaft 11
23 Stiffener connecting the connector 22 to the shaft 11
24 Auxiliary member fixing the connector 22 to the shaft 11
25 Nut
26*a* Mounting member placing the nut 25
26*b* Mounting member placing the nut 25
26*c* Mounting member placing the nut 25
27 Torsion spring
28 Movable shift member
29 Movable mechanism seat placing the torsion spring 27
30 Movable shaft
31 Line control
51 Soundproof rubber meson of the main base 1
52 Soundproof rubber meson of the seat bearing plate 2
53 Plastic tail covers of the shafts 11, 12, 13, 14
53 Snap ring

DETAILED DESCRIPTION OF THE EMBODIMENTS

Figure 2:
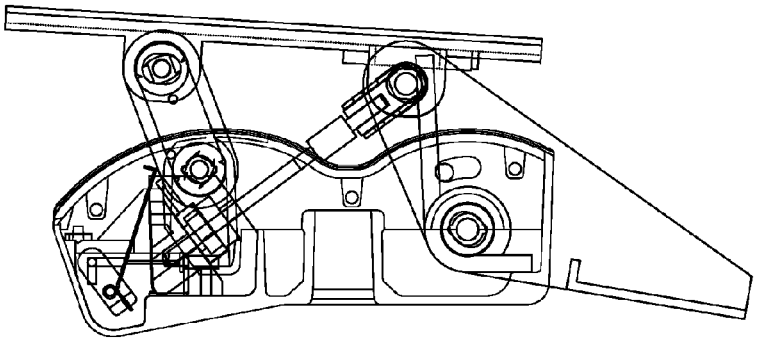
FIG. 2 is a schematic view of a rearward state of a chair chassis according to an embodiment of the present application.
Figure 3:
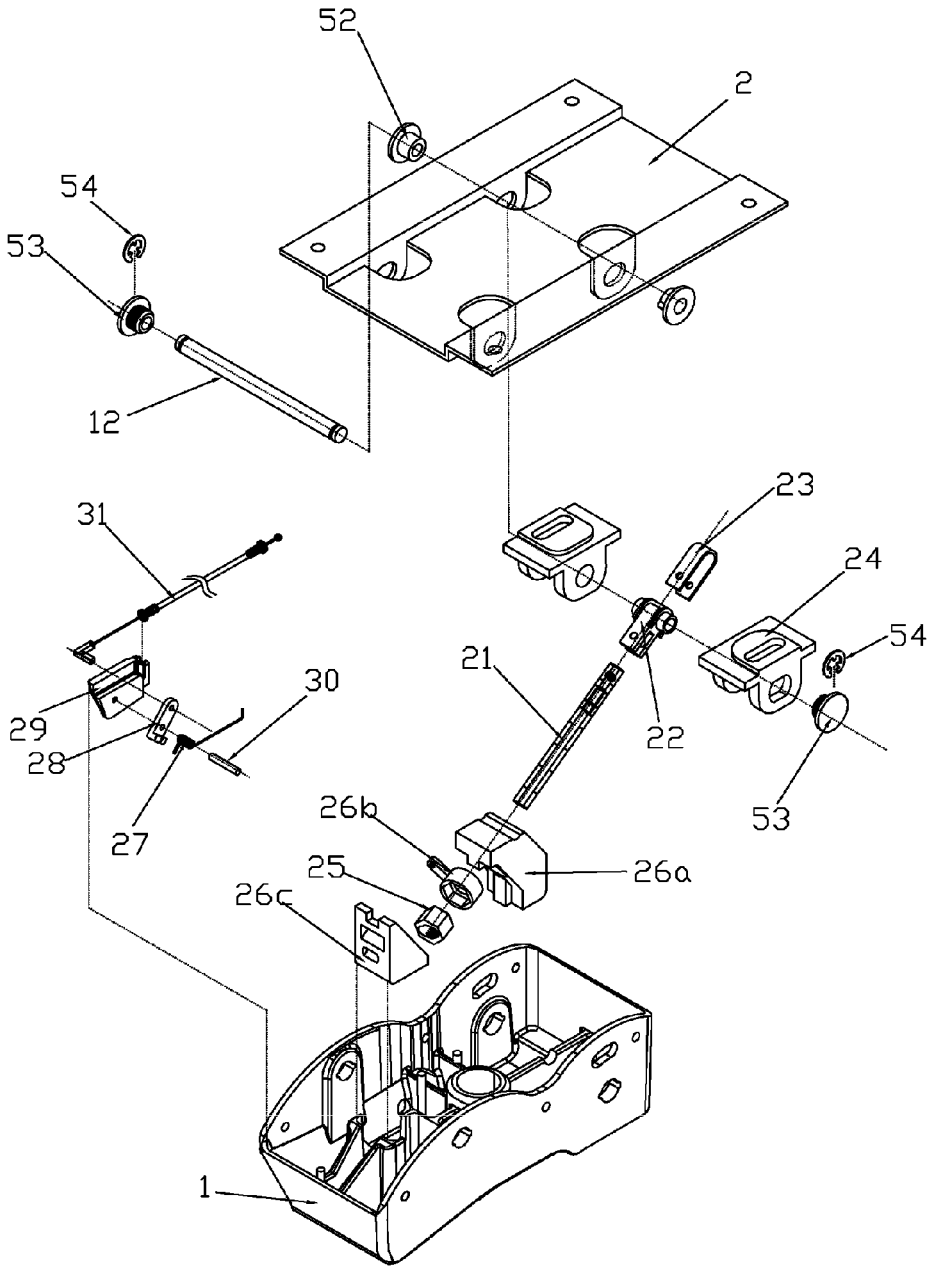
FIG. 3 is a schematic exploded view of a mounting structure according to an embodiment of the present application.

Referring to FIG. 1 to FIG. 3, according to some embodiments, a chair chassis includes a main tray base 1, a seat bearing plate 2, a movable support member 3 and a pair of movable supporting plates 4, where the seat bearing plate 2 is disposed above the main tray base 1, for bearing a seat 8, a front end of the movable support member 3 is pivotally connected to the seat bearing plate 2 by using a common shaft 12, a lower end of the movable support member 3 is pivotally connected to the main tray base 1 by using a common shaft 11, a lower end of the movable support member 3 is used for connecting a chair backrest 9, the front end, the lower end and the rear end of the movable support member 3 are in a triangle relationship and the front end and the rear end are pivotable by taking the lower end as a fulcrum, the pair of movable supporting plates 4 are located in front of the movable support member 3, upper and lower ends of each movable supporting plate 4 are respectively pivotally connected to the seat bearing plate 2 and the main tray base 1, so that the seat bearing plate 2 is subject to balanced support when moving with the movable support member 3, and a pivot where the movable support member 3 and the main tray base 1 are connected is mounted with an elastic member 5 for resisting the movable support member 3 from rotating rearward.

FIG. 1 shows a state that a chair user sits on the seat 8 but not tilts the chair backrest 9 rearward. As shown in FIG. 2, when the chair user leans back against the chair backrest 9, the front end of the movable support member 3 is subject to weight pressure of the user transferred downward by the seat bearing plate 2 and resistance of the elastic member 5 (equal to an elastic restoring force), the rear end of the movable support member 3 is subject to rearward pressure transferred downward by the backrest 9, their torque generates balance by taking a lower end of the movable support member 3 pivotally connected to the main tray base 1 as a fulcrum, if the weight pressure applied by a person is greater, balance is generated when the rearward pressure against the backrest 9 is greater, on the contrary, if the weight pressure applied by a person is smaller, balance can be generated when the rearward pressure against the backrest 9 is smaller. Therefore, in order to adjust rearward angle and position of the backrest 9, persons with different weights need to apply rearward pressure to the backrest 9 which automatically adapts according to weight pressure applied by the persons and degree of resistance of the elastic member 5, and this just meets different needs of users with different weights (generally, it is more comfortable for persons with greater weight when the reactive force of the backrest 9 that the back is subject to in the rearward process is greater, while it is more comfortable for persons with less weight when the reactive force is less), so that the user can adjust a rearward angle of the backrest 9 with ease according to his own weight, and control the backrest 9 to stay at an angle most suitable for the pressure produced on the back, so that a condition that the pressure of the backrest 9 on the back is excessively light or excessively oppressive may not occur during rearward adjustment and after the backrest 9 is stabilized at appropriate angle and position. When the user needs to reduce leaning back of the chair backrest 9, the user only needs to slightly lean forward, at this time, in order to balance a force transferred from the movable support member 3, the backrest 9 clings to the user's back to move forward, so that the rearward pressure of the user's back and the weight pressure applied by the user plus the current restoring force of the elastic member 5 are kept in a balanced state, but in the forward process, the restoring force of the elastic member 5 decreases, and thus the rearward pressure may also decrease correspondingly, in this way, the user may easily control the backrest for arbitrary adjustment, to reinstate the backrest or adjust the backrest to an angle that satisfies the user.

In addition to the advantages of adaptation to the weight of the user, as during rearward adjustment of the backrest 9, the seat bearing plate 2 moves toward an upper back direction synchronously with the backrest 9 under the driving of the front end of the movable support member 3, and thus the relative distance between the seat mounted on the seat bearing plate 2 and the backrest 9 may not be widened due to rearward movement of the backrest 9, which may effectively avoid or significantly reduce friction of the backrest 9 on the back of the user in the rearward process.

In a process that the movable support member 3 rotates forward or rearward around a fulcrum at the lower end thereof, a front end thereof pivotally connected to the seat bearing plate 2 drives the corresponding rear end of the seat bearing plate 2 to move along a sector track, that is, it is lifted upward while moving rearward, or its position is lowered while it moves forward. The movable supporting plates 4 located in front of the movable support member 3 provide the front end of the seat bearing plate 2 with a bearing force that balances the seat bearing plate 2, with the design that the upper and lower ends of the moveable supporting plates 4 are pivotally connected to the seat bearing plate 2 and the main tray base 1 respectively, in addition to providing the bearing force, the movable supporting plates 4 may also perform rearward or forward linkage with the movable support member 3 when the movable support member 3 drives the seat bearing plate 2 to move, to keep synchronous with movement of the movable support member 3.

As shown in FIG. 1 and FIG. 2, in a preferred embodiment, the size and the mounting position of the pair of movable supporting plates 4 meet a condition that a front end of the seat bearing plate 2 is at a lifted tilt angle relative to a rear end of the seat bearing plate 2 when the movable supporting plates 4 move rearward along with the seat bearing plate 2. The lifted tilt angle of the front end of the seat bearing plate 2 makes the user seated more stably and comfortably when leaning back against the backrest 9. Persons skilled in the art will understand that the size of the movable supporting plates 4 and their mounting positions at the main tray base 1 and the seat bearing plate 2 can be specifically designed according to actual requirements, so as to obtain an ideal tilt angle for different preferences.

As shown in FIG. 3, in a preferred embodiment, the main tray base 1 and the movable support member 3 are both trough-like members with a pair of sidewalls, a rear end of the main tray base 1 is embedded into a groove formed by the movable support member 3, corresponding sidewalls of the main tray base 1 and the movable support member 3 form a pivotal connection, two ends of the shaft 11 are respectively mounted in shaft holes of the two sidewalls of the main tray base 1 and the movable support member 3, the main tray base 1 and the pair of movable supporting plates 4 form a pivotal connection therebetween on the sidewalls of the main tray base 1, and two ends of a shaft 13 are respectively mounted on the two sidewalls of the main tray base 1 and shaft holes of the movable supporting plates 4. The seat bearing plate 2 forms a pivotal connection with the two sidewalls of the movable support member 3 by using one pair of side lugs at the rear end of the plate projecting downward, and two ends of the shaft 12 are respectively mounted in the pair of side lugs and the shaft holes of the two sidewalls of the movable support member 3. The seat bearing plate 2 forms a pivotal connection with the movable supporting plates 4 by using the other pair of side lugs at the front end of the plate projecting downward, and two ends of the shaft 14 are respectively mounted in the pair of side lugs and the shaft holes of the movable supporting plates 4. Preferably, the shape of the sidewalls of the movable support member 3 is substantially an obtuse angled triangle with a downward obtuse angle.

More preferably, a limit shaft 15 is fixed between the two sidewalls of the movable support member 3, two sidewalls of the main tray base 1 are opened with a limit slot whose shape is identical with the movement track of the movable support member 3, and the limit shaft 15 passes through the limit slot and only can move along the limit slot, so as to restrict the rotation range of the movable support member 3, thereby restricting the movement angle of the backrest 9.

As shown in FIG. 3, in a preferred embodiment, the elastic member 5 is a torsion spring, for example, it may be a pair of torsion springs, a main body portion of the torsion spring is fixed onto the pivot where the movable support member 3 and the main tray base 1 are connected, and an extending end of the torsion spring is pressed on a pivot where the movable support member 3 and the seat bearing plate 2 are connected.

Figure 4:
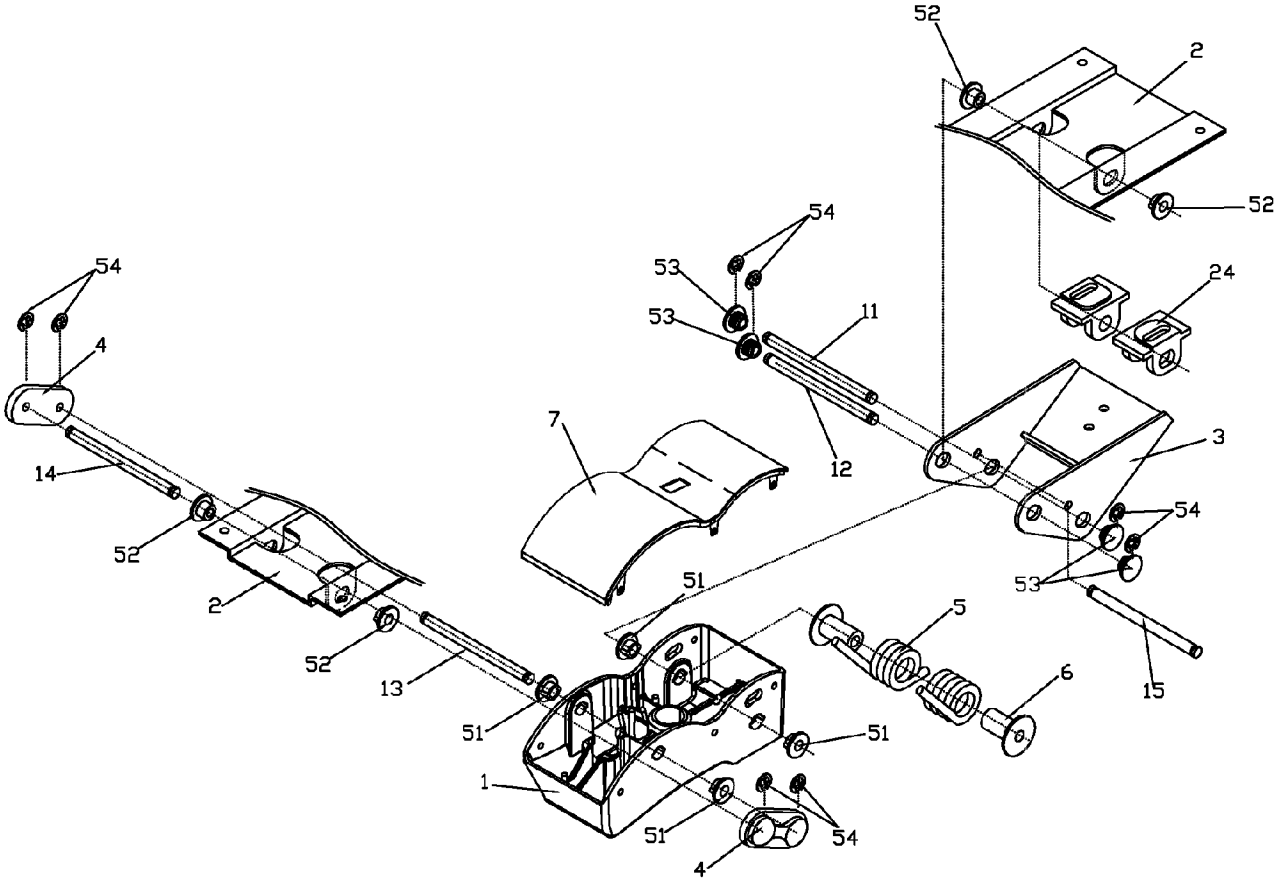
FIG. 4 is a schematic exploded view of a lock mechanism according to an embodiment of the present application.

As shown in FIG. 1, FIG. 2 and FIG. 4, the chair chassis may further include a lock mechanism disposed on the main tray base 1, where the lock mechanism is connected to the seat bearing plate 2 and/or the movable support member 3, for locking the seat bearing plate 2 and the movable support member 3.

As shown in FIG. 4, in a preferred embodiment, the lock mechanism includes a screw 21, a nut 25 and a line control assembly, the nut 25 is mounted in the main tray base 1, an upper end of the screw 21 is connected to the pivot where the movable support member 3 and the seat bearing plate 2 are connected, a lower end thereof is close to the front relative to the upper end and inserted into the nut 25, part of positions in an outer periphery of the screw 21 have teeth, part of positions in an inner periphery of the nut 25 have teeth, in a first rotational position of the nut 25, the teeth of the nut 25 and the screw 21 are engaged to fixed the screw 21, in a second rotational position of the nut 25, the teeth of the nut 25 and the screw 21 are dislocated so that the screw 21 can move freely in the nut 25, and the line control assembly is connected to the nut 25, for controlling the nut 25 to switch between the first rotational position and the second rotational position.

In a more preferred embodiment, the lower end of the screw 21 is flat, two flat surfaces thereof are in a vertical position, left and right sides have teeth, in the first rotational position of the nut 25, the teeth of the nut 25 are in a vertical position opposite to the flat surfaces, and the inner diameter of left and right directions of the nut 25 is greater than the width of the screw 21, and in the second rotational position of the nut 25 at an angle of 90 degrees with the first rotational position, the teeth of the nut 25 rotate to a lateral position where the teeth of the nut 25 are engaged with the teeth on left and right sides of the screw 21, to lock the screw 21.

With the lock mechanism, the nut 25 can be controlled to rotate to different angles by a line control 31, and the nut 25 can be switched to a state of locking the screw 21, and can also be switched to a state that the screw 21 moves freely in the nut 25, so that the user can lock the screw 21 or release the screw 21 by means of the line control 31, thereby locking the movable support member 3 and the seat bearing plate 2 at appropriate positions by locking the length of the screw 21 inserted into the nut 25, or release the screw 21, making the movable support member 3 and the seat bearing plate 2 movable, so as to adjust the rearward angle of the backrest 9.

As shown in FIG. 4, in a specific embodiment, the line control assembly includes a line control 31, a movable shift member 28, a movable shaft 30, a torsion spring 27 and a nut 25 kit, the nut 25 is fixed into the nut 25 kit, the nut 25 kit has a projecting side portion, the side portion has a groove, the line control 31 is connected to the movable shift member 28, the torsion spring 27 is fixed onto the movable shift member 28 by using the movable shaft 30, the extending end of the torsion spring 27 is limited to the groove of the side portion of the nut 25 kit, and in/out movement of the line control 31 drives the nut 25 kit to rotate through the movable shift member 28 and the torsion spring 27 to drive the nut 25 to switch between the first rotational position and the second rotational position.

As shown in FIGS. 1-3, in another specific embodiment, the chair chassis may further include a top cover 7 mounted on the main tray base 1, where the top cover 7 is opened with holes for movement of the elastic member 5 and the lock mechanism.

In addition, the chair chassis may further include a lifting regulation component mounted in the main tray base 1, where the lifting regulation component is used for achieving lifting regulation and positioning of the seat. The lifting regulation component may be achieved with the lifting structure of the conventional chair chassis, which is not described in detail herein.

Figure 5:
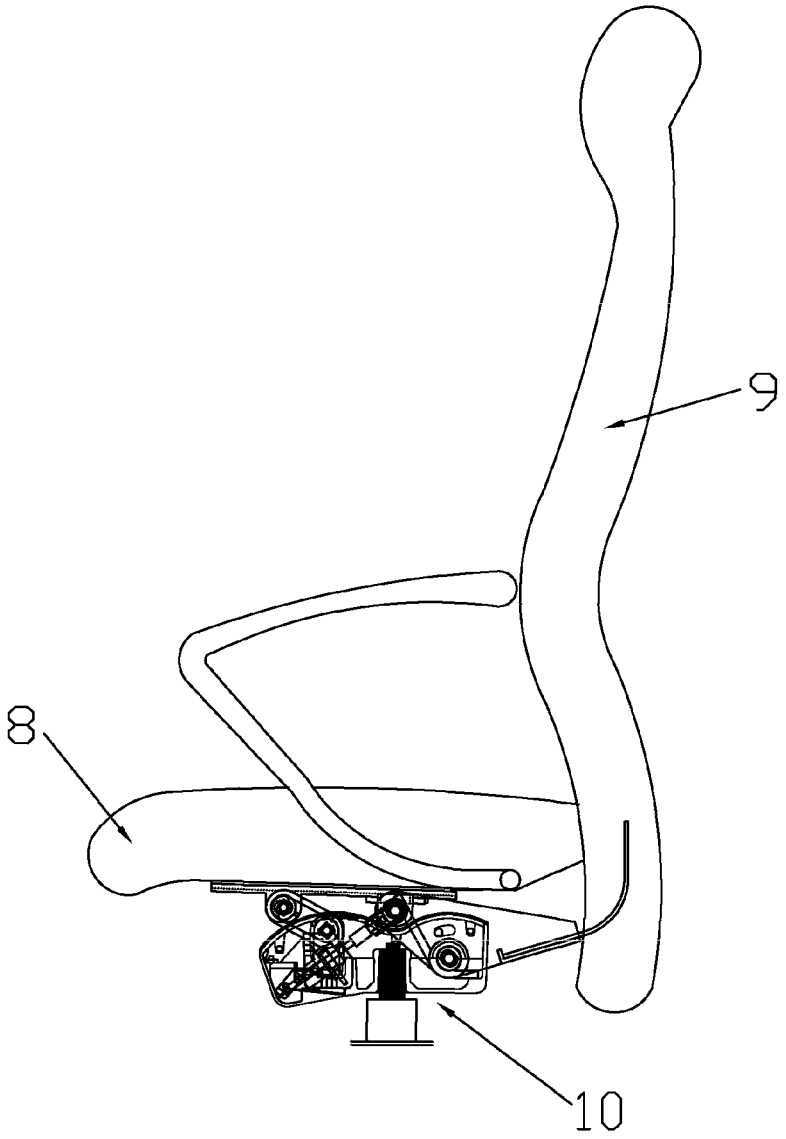
FIG. 5 is a schematic view of an initial state of a chair according to an embodiment of the present application.
Figure 6:
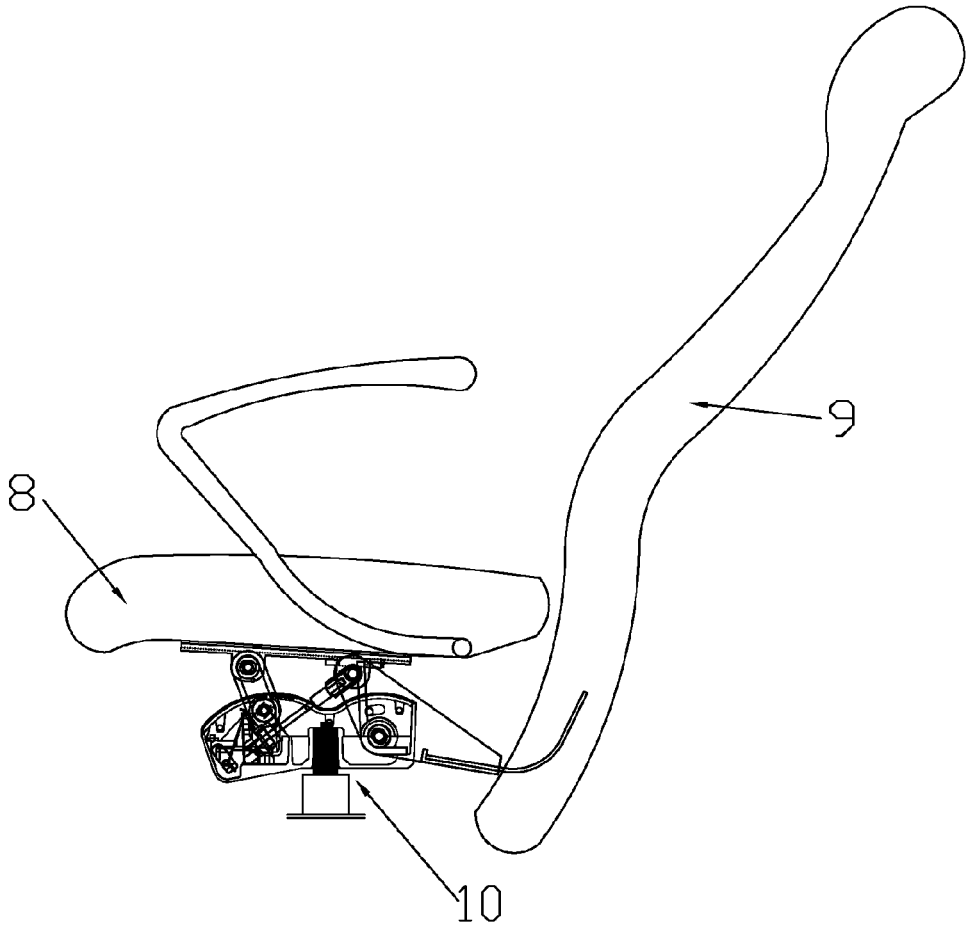
FIG. 6 is a schematic view of a rearward state of a chair according to an embodiment of the present application.

As shown in FIG. 5 and FIG. 6, another embodiment relates to a chair, including a seat 8, a backrest 9 and a chair chassis 10, where the chair chassis 10 is connected to the backrest 9 and supports the seat 8. The chair chassis 10 may be the chair chassis in any of the previous embodiments, which is not repeated herein.

The words "front" and "rear" herein are in terms of front and rear directions of the chair, for example, the seat 8 is located in front relative to the backrest 9.

What is claimed is:

1. A chair chassis, comprising: a main tray base, a seat bearing plate, a movable support member and a pair of movable supporting plates, wherein the seat bearing plate is disposed above the main tray base, for bearing a seat, a front end of the movable support member is pivotally connected to the seat bearing plate, a lower end of the movable support member is pivotally connected to the main tray base, a rear end of the movable support member is used for connecting a chair backrest, the front end, the lower end and the rear end of the movable support member are in a triangle relationship and the front end and the rear end are pivotable by taking the lower end as a fulcrum, the pair of movable supporting plates are located in front of the movable support member, upper and lower ends of each movable supporting plate are respectively pivotally connected to the seat bearing plate and the main tray base, so that the seat bearing plate is subject to balanced support when moving with the movable support member, and a pivot where the movable support member and the main tray base are connected is mounted with an elastic member for resisting the movable support member from rotating rearward, further comprising a lock mechanism disposed on the main tray base, wherein the lock mechanism is connected to the seat bearing plate and the movable support member, for locking the seat bearing plate and the movable support member, wherein the lock mechanism comprises a screw, a nut and a line control assembly, the nut is mounted in the main tray base, an upper end of the screw is connected to the pivot where the movable support member and the seat bearing plate are connected, a lower end of the screw is close to the front relative to the upper end and inserted into the nut, part of positions in an outer periphery of the screw have teeth, part of positions in an inner periphery of the nut have teeth, in a first rotational position of the nut, the teeth of the nut and the screw are engaged to fixed the screw, in a second rotational position of the nut, the teeth of the nut and the screw are dislocated so that the screw can move freely in the nut, and the line control assembly is connected to the nut, for controlling the nut to switch between the first rotational position and the second rotational position.

2. The chair chassis according to claim 1, wherein the elastic member is a torsion spring, a main body portion of the torsion spring is fixed onto the pivot where the movable support member and the main tray base are connected, and an extending end of the torsion spring is pressed on a pivot where the movable support member and the seat bearing plate are connected.

3. The chair chassis according to claim 2, wherein the line control assembly comprises a line control, a movable shift member, a movable shaft, a torsion spring and a nut kit, the nut is fixed into the nut kit, the nut kit has a projecting side portion, the side portion has a groove, the line control is connected to the movable shift member, the torsion spring is fixed onto the movable shift member by using the movable shaft, the extending end of the torsion spring is limited to the groove of the side portion of the nut kit, and movement of the line control drives the nut kit to rotate by using the movable shift member and the torsion spring to drive the nut to switch between the first rotational position and the second rotational position.

4. The chair chassis according to claim 2, wherein the main tray base and the movable support member are both trough-like members with a pair of sidewalls, a rear end of the main tray base is embedded into a groove defined by the movable support member, a pivotal connection is formed between the main tray base and the movable support member and between the main tray base and the pair of movable supporting plates on corresponding sidewalls, and the seat bearing plate forms the pivotal connection with the pair of movable supporting plates and the sidewalls of the movable support member respectively by using two pairs of side lugs projecting downward from the bottom of the plate.

5. The chair chassis according to claim 2, wherein the size and the mounting position of the pair of movable supporting plates meet a condition that a front end of the seat bearing plate is at a lifted tilt angle relative to a rear end of the seat bearing plate in a state that the movable supporting plates move rearward along with the seat bearing plate.

6. The chair chassis according to claim 1, wherein the lower end of the screw is flat, two flat surfaces are in a vertical position, left and right sides have teeth, in the first rotational position of the nut, the teeth of the nut are in a vertical position opposite to the flat surfaces, and the inner diameter of left and right directions of the nut is greater than the width of the screw, and in the second rotational position of the nut at an angle of 90 degrees with the first rotational position, the teeth of the nut rotate to a lateral position where the teeth of the nut are engaged with the teeth on left and right sides of the screw, to lock the screw.

7. The chair chassis according to claim 1, wherein the line control assembly comprises a line control, a movable shift member, a movable shaft, a torsion spring and a nut kit, the nut is fixed into the nut kit, the nut kit has a projecting side portion, the side portion has a groove, the line control is connected to the movable shift member, the torsion spring is fixed onto the movable shift member by using the movable shaft, the extending end of the torsion spring is limited to the groove of the side portion of the nut kit, and movement of the line control drives the nut kit to rotate by using the movable shift member and the torsion spring to drive the nut to switch between the first rotational position and the second rotational position.

8. The chair chassis according to claim 1, further comprising a top cover mounted on the main tray base, wherein the top cover is opened with holes for movement of the elastic member and the lock mechanism.

9. The chair chassis according to claim 1, wherein the main tray base and the movable support member are both trough-like members with a pair of sidewalls, a rear end of the main tray base is embedded into a groove defined by the movable support member, a pivotal connection is formed between the main tray base and the movable support member and between the main tray base and the pair of movable supporting plates on corresponding sidewalls, and the seat bearing plate forms the pivotal connection with the pair of movable supporting plates and the sidewalls of the movable support member respectively by using two pairs of side lugs projecting downward from the bottom of the plate.

10. The chair chassis according to claim 1, wherein the size and the mounting position of the pair of movable supporting plates meet a condition that a front end of the seat bearing plate is at a lifted tilt angle relative to a rear end of the seat bearing plate in a state that the movable supporting plates move rearward along with the seat bearing plate.

11. A chair, comprising a seat, a backrest, and the chair chassis according to claim 1, wherein the chair chassis is connected to the backrest and supports the seat.

12. The chair according to claim 11, wherein the elastic member of the chair chassis is a torsion spring, a main body portion of the torsion spring is fixed onto the pivot where the movable support member and the main tray base are connected, and an extending end of the torsion spring is pressed on a pivot where the movable support member and the seat bearing plate are connected.

13. The chair according to claim 11, wherein the lower end of the screw is flat, two flat surfaces are in a vertical position, left and right sides have teeth, in the first rotational position of the nut, the teeth of the nut are in a vertical position opposite to the flat surfaces, and the inner diameter of left and right directions of the nut is greater than the width of the screw, and in the second rotational position of the nut at an angle of 90 degrees with the first rotational position, the teeth of the nut rotate to a lateral position where the teeth of the nut are engaged with the teeth on left and right sides of the screw, to lock the screw.

14. The chair according to claim 11, wherein the line control assembly comprises a line control, a movable shift member, a movable shaft, a torsion spring and a nut kit, the nut is fixed into the nut kit, the nut kit has a projecting side portion, the side portion has a groove, the line control is connected to the movable shift member, the torsion spring is fixed onto the movable shift member by using the movable shaft, the extending end of the torsion spring is limited to the groove of the side portion of the nut kit, and movement of the line control drives the nut kit to rotate by using the movable shift member and the torsion spring to drive the nut to switch between the first rotational position and the second rotational position.

* * * * *